US008602408B2

(12) United States Patent
Motoki

(10) Patent No.: US 8,602,408 B2
(45) Date of Patent: Dec. 10, 2013

(54) FEED TRAY

(75) Inventor: Zenko Motoki, Miyagi-ken (JP)

(73) Assignees: Alps Electric Co., Ltd., Tokyo (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/398,045

(22) Filed: Feb. 16, 2012

(65) Prior Publication Data

US 2012/0211937 A1 Aug. 23, 2012

(30) Foreign Application Priority Data

Feb. 21, 2011 (JP) ..... 2011-034610

(51) Int. Cl.
*B65H 1/00* (2006.01)

(52) U.S. Cl.
USPC ..... 271/145

(58) Field of Classification Search
USPC ..... 271/145, 127, 9.09, 9.11
See application file for complete search history.

(56) References Cited

U.S. PATENT DOCUMENTS

| | | | | | |
|---|---|---|---|---|---|
| 4,791,457 | A | * | 12/1988 | Shida | 399/392 |
| 4,870,285 | A | * | 9/1989 | Ohgoda | 250/484.4 |
| 5,222,722 | A | * | 6/1993 | Kamano | 271/9.09 |
| 5,346,197 | A | * | 9/1994 | Takano et al. | 271/9.05 |
| 5,695,182 | A | * | 12/1997 | Sekine | 271/9.09 |
| 5,752,696 | A | * | 5/1998 | Nakatani et al. | 271/127 |
| 5,957,447 | A | * | 9/1999 | Sekine | 271/9.09 |
| 6,659,444 | B2 | * | 12/2003 | Kawarama | 271/9.09 |
| 7,784,781 | B2 | * | 8/2010 | Asada | 271/145 |
| 8,016,285 | B2 | * | 9/2011 | Horiuchi et al. | 271/145 |
| 2006/0012110 | A1 | * | 1/2006 | Yamamoto et al. | 271/145 |
| 2007/0126172 | A1 | * | 6/2007 | Nakamura et al. | 271/145 |
| 2009/0085278 | A1 | * | 4/2009 | Izuchi et al. | 271/145 |
| 2012/0001378 | A1 | * | 1/2012 | Izuchi et al. | 271/9.11 |

FOREIGN PATENT DOCUMENTS

JP 2002-332126 11/2002

* cited by examiner

*Primary Examiner* — Kaitlin Joerger
(74) *Attorney, Agent, or Firm* — Brinks Gilson & Lione

(57) ABSTRACT

A cover of a feed tray is attached to a tray body in a movable manner in a direction away from the tray body when the cover is in a closed state for covering an upper surface of the tray body.

2 Claims, 6 Drawing Sheets

FEED TRAY

CLAIM OF PRIORITY

This application claims benefit of Japanese Patent Application No. 2011-034610 filed on Feb. 21, 2011, which is hereby incorporated by reference in its entirey.

BACKGROUND

1. Field of the Disclosure

The present disclosure relates to a feed tray that is fitted to a recording apparatus while accommodating a stack of multiple sheets and that is provided for feeding each sheet to a recording unit of the recording apparatus via a feed roller.

2. Description of the Related Art

Generally, the aforementioned feed tray has a box-shaped tray body having an upper opening so as to accommodate therein a stack of multiple sheets.

The tray body is provided with a trailing-edge positioning plate for positionally regulating the trailing edges of the sheets and movable side plates for positionally regulating the side edges of the sheets. The downstream side, in the feeding direction, of a bottom plate of the tray body is provided with a hole into which a sheet biasing member disposed in the recording apparatus can be inserted when the feed tray is fitted to the recording apparatus.

Furthermore, a tray plate is disposed on the bottom plate of the tray body in a pivotable manner so as to bring the downstream side of the sheets into pressure contact with a feed roller in the recording apparatus. The tray plate is a substantially rectangular thin plate that at least supports the leading edges, located at the downstream side in the feeding direction, of the sheets stacked and accommodated in the tray body. The rear end of the tray plate at the upstream side is supported by the upstream side of the bottom plate of the tray body relative to the aforementioned hole so that the front end of the tray plate at the downstream side is rotatable upward.

Furthermore, a cover is disposed on the tray body. The cover includes a first cover that is fixed so as to cover an area excluding an open area (referred to as "feed open area" hereinafter) of the tray body disposed facing the feed roller of the recording apparatus when the feed tray is fitted to the recording apparatus, and a second cover that is fixed so as to cover the feed open area when the feed tray is detached from the recording apparatus, thereby covering the entire opening of the tray body together with the first cover. The feed open area is located at the downstream side of the opening of the tray body.

In the feed tray in the related art, the sheets are stacked and placed on the inner surface of the tray body so as to be accommodated therein while the area excluding the feed open area of the tray body is covered by the cover (first cover). Then, when the end with the feed open area is fitted to one side of the recording apparatus (such that the feed tray extends outward from the recording apparatus and is supported in a cantilevered manner), a feed motor is driven so that the sheet biasing member is inserted into the tray body through the hole. Thus, the sheet biasing member rotates and biases the front end of the tray plate upward about the rear end of the tray plate acting as a pivot axis, so that the sheets placed on the tray plate are brought into pressure contact with the feed roller through the feed open area. Consequently, the uppermost sheet is brought into pressure contact with the lower side of the feed roller. When the feed roller is rotationally driven in this state, a frictional force between the feed roller and the uppermost sheet causes the sheet to become separated from the remaining sheets disposed therebelow, whereby the uppermost sheet is delivered (fed) from the tray body toward a printing position of the recording apparatus (for example, see Japanese Unexamined Patent Application Publication No. 2002-332126).

Generally, sheets that are formed by unwinding a large-diameter roll of wide roll paper, whose print surface faces inward, and cutting the roll paper into individual sheets with predetermined dimensions tend to curl in the longitudinal direction of the roll paper (i.e., the direction in which the roll paper was wound in a roll) depending on storage conditions.

In the feed tray in the related art having the fixed cover and fitted to the recording apparatus while accommodating a stack of multiple sheets, since the depth of the tray body is not adjustable, if such curled sheets are to be accommodated therein, it is necessary to remove some sheets that are equivalent to the height of the curl. For this reason, the feed tray can only accommodate a certain number of sheets that is smaller than a predetermined maximum number of sheets that can be accommodated in the feed tray. For example, if a set of 18 thick sheets P are curled, the number of sheets equivalent to the height of the curl would need to be removed, as shown in FIG. 6B, even though the feed tray is normally capable of accommodating all of the sheets if they were not curled, as shown in FIG. 6A. If the cover is forcedly fixed to the tray body by pressing on the curled sheets without removing any sheets, sliding friction between the cover and the sheet being conveyed would increase, making it difficult to perform a smooth feeding process and thus resulting in a feed error, such as a state where the sheet is not conveyed.

If the tray body is designed with a plenty of depth so as to be always capable of accommodating the same number of sheets, the feed tray would naturally become large in size, which is against the demands for size reduction and thickness reduction of the recording apparatus.

Furthermore, if the sheet to be fed for recording is curled in the width direction, the sheet may partially abut or slide on the lower side of the cover (first cover) or the edges of the feed open area, sometimes inhibiting a stable sheet conveying process. Therefore, for example, in a feed tray for a recording apparatus in which sheets whose side edges, in the width direction, tend to curl upward from the print surface (upper surface) relative to the middle are expected to be used as sheets to be fed for recording, an edge of the cover proximate to the aforementioned opening is formed such that the sides thereof in the width direction are gradually curved away from the opening in plan view relative to the middle so as to form a clearance (slide avoiding section) for reducing contact (sliding) between the opposite side edges of the curled sheet and the cover. This prevents the inhibition of the sheet conveying process caused by the sheet abutting on the cover.

However, the feed tray having the clearance in the cover has problems in that, when the clearance is located outside the recording apparatus in a state where the feed tray is fitted to the recording apparatus, dust and foreign matter (simply referred to as "foreign matter" hereinafter) can easily enter the feed tray through the clearance, or the accommodated sheets exposed through the clearance may become discolored due to exposure to sunlight. In addition, when printing operation is performed in a state where foreign matter is adhered to a sheet, not only is the print result is adversely affected, but also the thermal head may break as a result of the foreign matter adhering to the thermal head.

The present invention provides a feed tray that allows for a stable sheet conveying process regardless of whether or not a sheet is curled, that can accommodate a maximum number of sheets even if they are curled, without being increased in thickness, and that can prevent foreign matter from entering the feed tray as well as preventing discoloration of the sheets caused by exposure to sunlight in a state where the feed tray is fitted to a recording apparatus.

SUMMARY

A feed tray includes a tray body that is fittable to a recording apparatus and that is capable of accommodating a stack of multiple sheets, a tray plate that is disposed at a bottom of the tray body and that is pivotable so as to bring a downstream side of the accommodated sheets in a feeding direction into pressure contact with a feed roller disposed in the recording apparatus; and a cover having a top plate that covers an upstream side, in the feeding direction, of an upper surface of the tray body. The cover is attached to the tray body in a movable manner in a direction away from the tray body when the cover is in a closed state for covering the upper surface of the tray body. The top plate covers an entire upstream area, in the feeding direction, of the upper surface of the tray body extending outward from the recording apparatus when the feed tray is fitted to the recording apparatus.

In the feed tray according to the present invention, the cover is attached to the tray body in a movable manner in a direction away from the tray body when the cover is in the closed state for covering the upper surface of the tray body. Therefore, even when the sheets to be fed for recording are curled in the width direction and are thus difficult to fit within the tray body regardless of the fact that the number of curled sheets corresponds to the maximum number of non-curled sheets that can be accommodated in the feed tray, the feed tray can still accommodate all of or nearly all of the curled sheets by moving the cover away from the tray body, and feed each sheet for recording.

Even when the sheets are curled in the width direction, the feed tray is still set in the recording apparatus. When performing a conveying process, the curled sheets are uncurled in the following manner so as to be fed for recording in a similar manner to normal non-curled sheets. Specifically, the tray plate disposed at the bottom plate of the tray body pivots so that the downstream side of the tray plate brings the sheets into pressure contact with the feed roller disposed in the recording apparatus. At this time, the sheets not covered by the cover at the downstream side of the upper surface of the tray body are nipped between the feed roller and the tray plate, thereby uncurling the sheets.

In this case, the cover moves away from the tray body so that trouble in the feeding process caused by sliding friction between the sheet being conveyed and the cover is effectively prevented, at least compared with the related art in which the cover is fixed to the tray body.

Accordingly, the feed tray according to the present invention allows for a stable sheet conveying process regardless of whether or not a sheet is curled in the width direction, and can solve the aforementioned problems without being increased in thickness.

Specifically, the upstream side of the cover is axially supported so that the cover is rotatable relative to the tray body, and the pair of lock portions for locking the cover and the tray body to each other when the cover is in the closed state for covering the upper surface of the tray body are provided such that the lock portions are capable of adjusting the locked state, whereby the feed tray having the aforementioned advantages can be achieved.

In the above-described feed tray that can effectively prevent trouble in the feeding process caused by the sliding friction between the sheet and the cover, the top plate that covers the entire upstream area of the upper surface of the tray body extending outward from the recording apparatus when the feed tray is fitted to the recording apparatus does not need to be provided with a clearance as in the feed tray in the related art, whereby the top plate can have a downstream edge that extends linearly in the direction perpendicular to the feeding direction.

Such a feed tray not having a clearance in the top plate of the cover can effectively prevent foreign matter from entering the tray body, and can also prevent the sheets accommodated in the feed tray from being exposed to sunlight when the feed tray is fitted to the recording apparatus, thereby reliably preventing discoloration of the sheets caused by exposure to sunlight. Furthermore, since the downstream edge of the top plate may extend linearly in the direction perpendicular to the feeding direction, even when the sheet being conveyed slides into contact with the downstream edge, the sheet would come into contact with the cover substantially uniformly in the width direction of the sheet, whereby the sheet can be advantageously prevented from being skewed.

DESCRIPTION OF THE EXEMPLARY EMBODIMENTS

A feed tray according to an embodiment of the present invention will be described below with reference to FIGS. 1A to 5B.

Figure 1D:
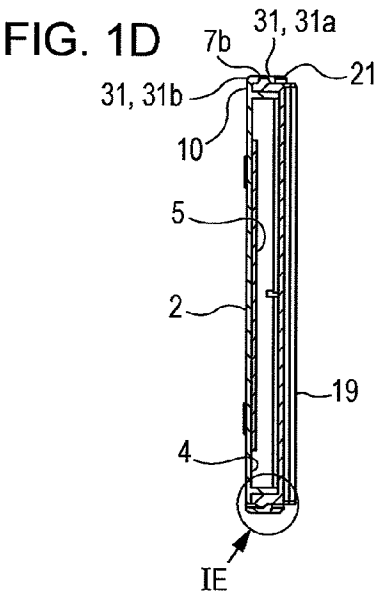
FIGS. 1A to 1E illustrate a state where a first cover set in a normal position covers an upper surface of a tray body in a feed tray according to an embodiment, FIG. 1A being a plan view, FIG. 1B being a front view, FIG. 1C being a cross-sectional view taken along line IC-IC in FIG. 1A, FIG. 1D being a cross-sectional view taken along line ID-ID in FIG. 1A, FIG. 1E being an enlarged view of a relevant part in FIG. 1D.
Figure 1E:
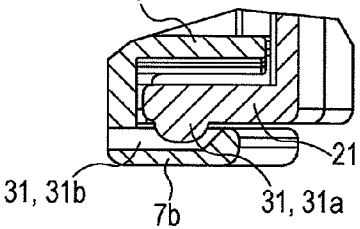
Figure 1A:
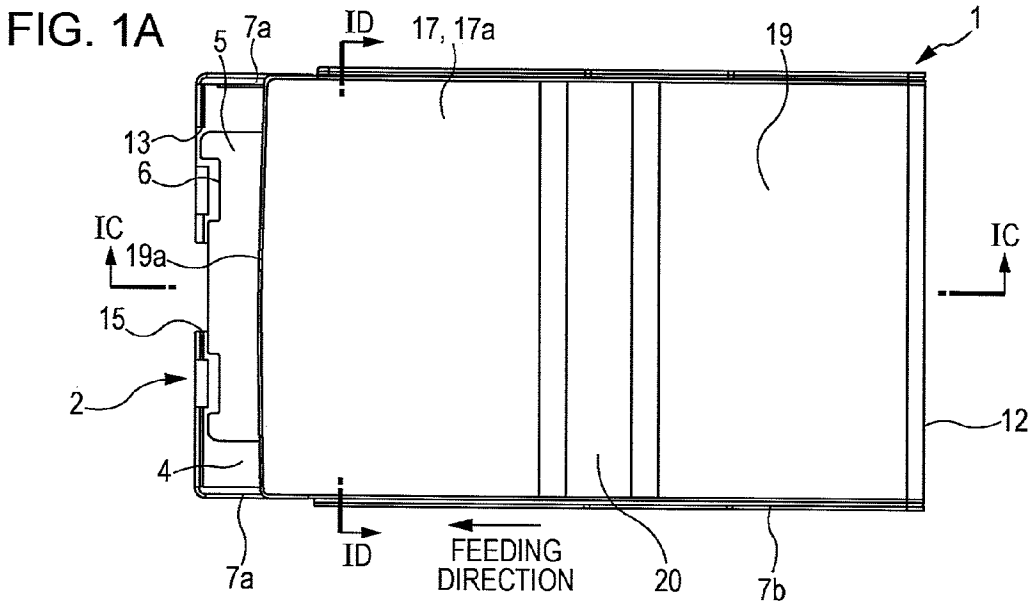
Figure 1B:
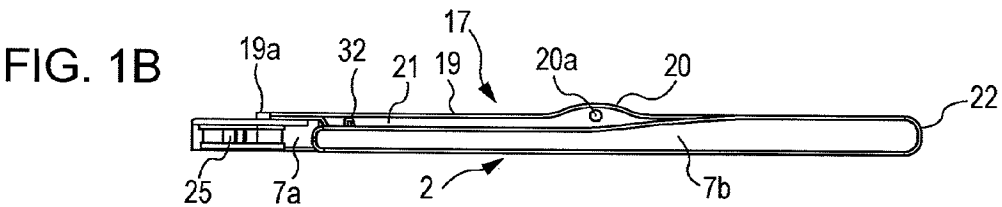
Figure 1C:
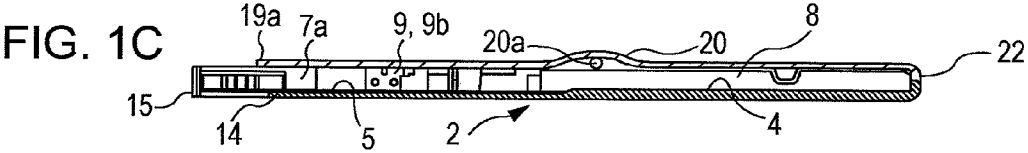
Figure 2A:
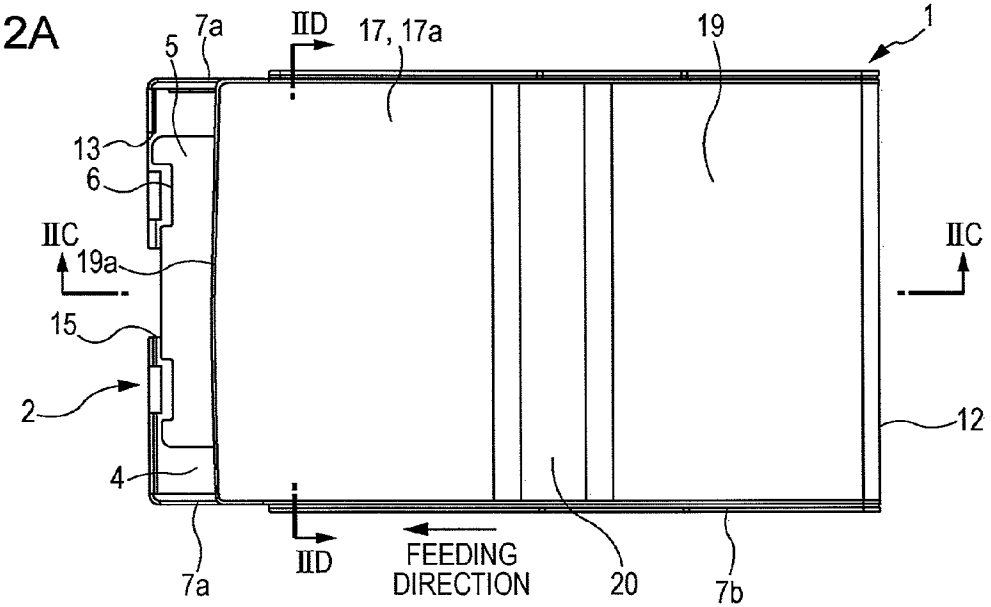
FIGS. 2A to 2E illustrate a state where the first cover is pushed upward so that a top plate set in a rotated position covers the upper surface of the tray body in the feed tray according to the embodiment, FIG. 2A being a plan view, FIG. 2B being a front view, FIG. 2C being a cross-sectional view taken along line IIC-IIC in FIG. 2A, FIG. 2D being a cross-sectional view taken along line IID-IID in FIG. 2A, FIG. 2E being an enlarged view of a relevant part in FIG. 2D.
Figure 2D:
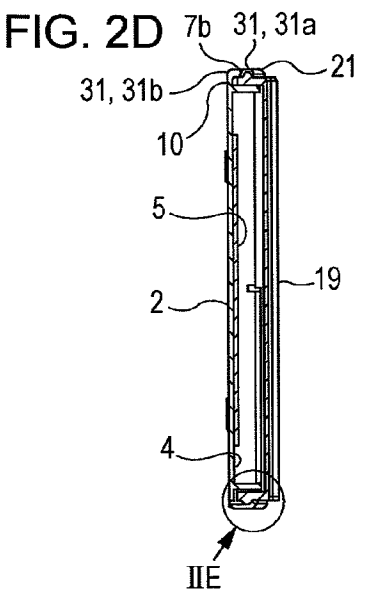
Figure 5A:
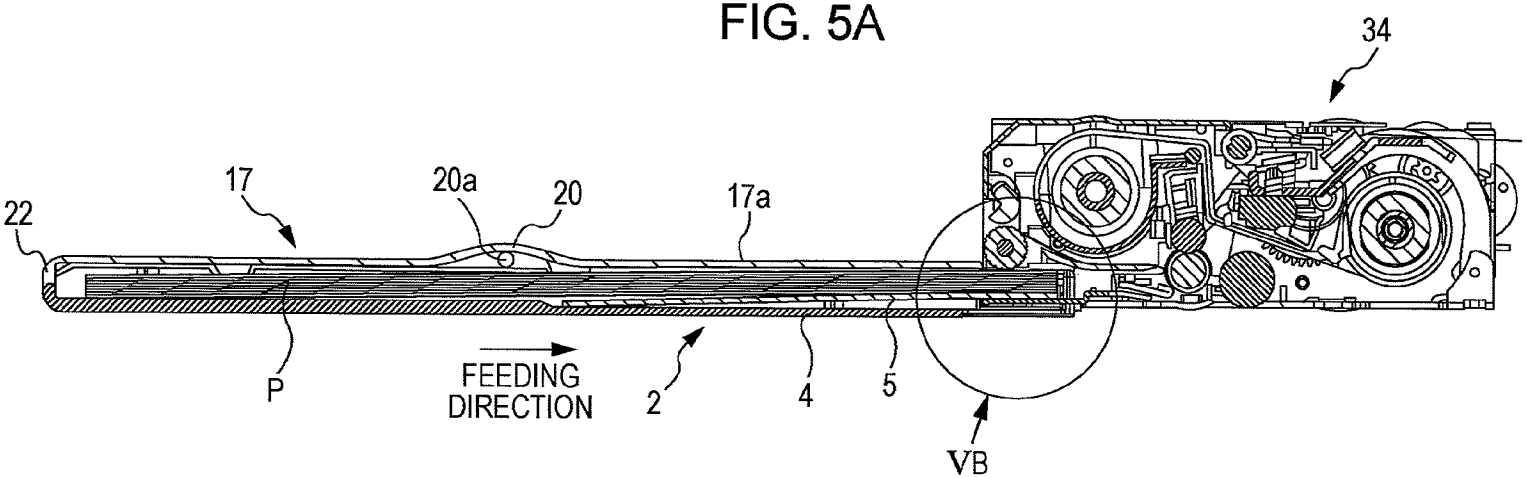
FIG. 5A is a cross-sectional view of a relevant part showing a state where the feed tray is fitted to a printer.

A feed tray 1 according to the present embodiment is capable of feeding a sheet P in a feeding direction indicated by an arrow in FIGS. 1A, 2A, and 5A, and has a substantially tabular tray body 2 that can support a stack of multiple sheets P on one surface thereof.

Figure 3:
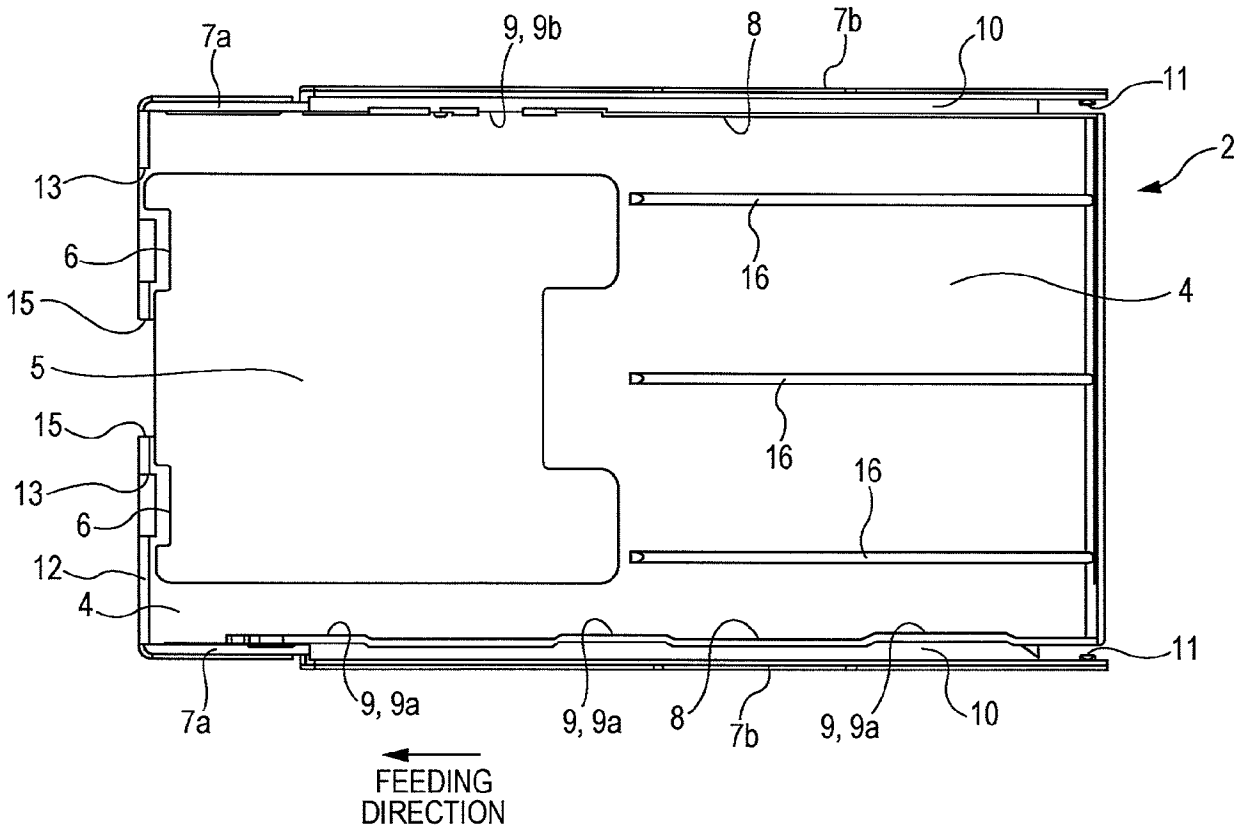
FIG. 3 is a plan view of the tray body in the feed tray according to the embodiment.
Figure 4:
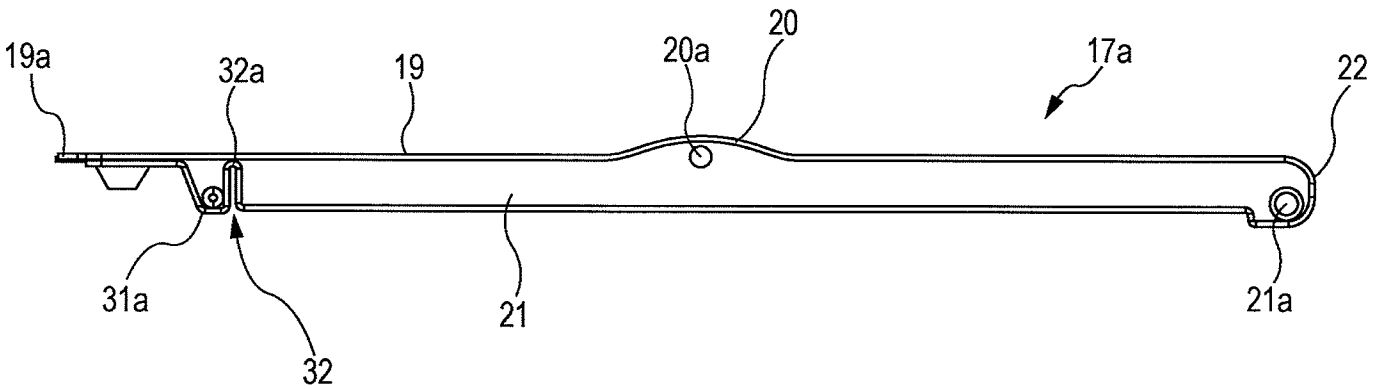
FIG. 4 is a side view of the first cover in the feed tray according to the embodiment.

As shown in FIG. 3, the tray body 2 has a substantially tabular bottom plate 4 serving as a sheet support surface for supporting the sheets P. A substantially rectangular thin tray plate 5 is disposed on the inner surface of the bottom plate 4 in a freely pivotable manner such that a front edge of the tray plate 5 located at the downstream side in the feeding direction (simply referred to as "downstream side" hereinafter) is movable away from the bottom plate 4 about a pivot axis defined by a rear edge of the tray plate 5 located at the upstream side in the feeding direction (simply referred to as "upstream side" hereinafter). Since this mechanism that functions as a pivot axis may be achieved by using a commonly known mechanism, a description thereof will be omitted here.

Furthermore, the tray plate 5 is disposed such that the front edge thereof extends along the vicinity of a front edge of the bottom plate 4 of the tray body 2 in the feeding direction. The front edge of the tray plate 5 is provided with a pair of rectangular cutouts 6 at symmetric positions with respect to the center of the tray plate 5 in the width direction thereof. The bottom plate 4 is exposed through these cutouts 6. The exposed areas of the bottom plate 4 serve as mounting sections for mounting the tray body 2 to a recording apparatus 34.

The front edge of the tray plate 5 formed in a shape of a comb by the two cutouts 6 supports the leading edges of the lower surfaces of the sheets P accommodated above the bottom plate 4 and serves as a sheet friction section during a feeding process. The tray plate 5 may be entirely composed of a rigid material having a high coefficient of friction relative to the sheets P.

Left and right sides of the bottom plate 4 in a direction (referred to as "width direction" hereinafter) perpendicular to the feeding direction are respectively provided with a pair of left and right first side plates 7*a* and a pair of left and right second side plates 7*b* that extend perpendicularly from the bottom plate 4. Specifically, the first side plates 7*a* are located at the downstream side, whereas the second side plates 7*b* are located at the upstream side and are connected to the first side plates 7*a*.

Furthermore, left and right sheet-side guide members 8 substantially having a tabular shape extend perpendicularly from the bottom plate 4. Specifically, the two sheet-side guide members 8 are disposed inward of the second side plates 7*b* of the tray body 2 and are connected to the first side plates 7*a* at the downstream side. The sheet-side guide members 8 are provided for positionally guiding the side edges of each sheet P to be fed for recording, and longitudinally extend parallel to the feeding direction.

In the present embodiment, one of the sheet-side guide members 8 located at the left side as viewed in the feeding direction in FIG. 3 is provided with protrusions 9*a* serving as positioning adjustment members 9 that abut on one side edge of each sheet P so as to accurately position the side edge. The other sheet-side guide member 8 located at the right side is provided with a leaf spring 9*b* serving as a positioning adjustment member 9 that abuts on the other side edge of each sheet P so as to press the sheet P against the protrusions 9*a*.

The second side plates 7*b* and the sheet-side guide members 8 disposed at the left and right sides of the bottom plate 4 are spaced apart from each other by cover accommodating sections 10 that accommodate side plates 21 of a first cover 17*a*, to be described later. The upstream side of each cover accommodating section 10 is an open end. The second side plates 7*b* near the open ends of the cover accommodating sections 10 are provided with pins 11 that protrude into the cover accommodating sections 10 and that function as rotation shafts when the first cover 17*a* is rotated away (i.e., upward) from the tray body 2.

In the present embodiment, the first side plates 7*a* are provided with lock-member engagement sections 25 that are engageable with lock members formed in a second cover (not shown), to be described later.

Figure 5B:
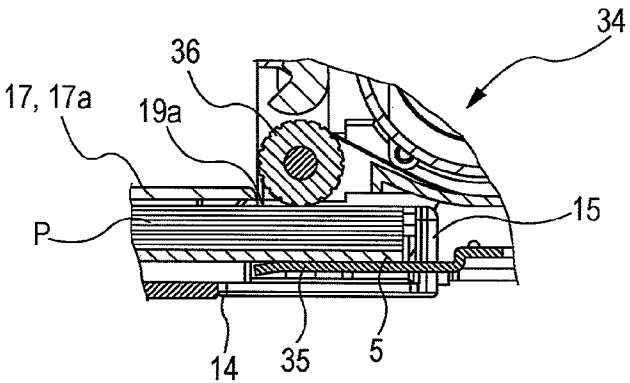
FIG. 5B is a partially enlarged view of the feed tray.
Figure 6A:
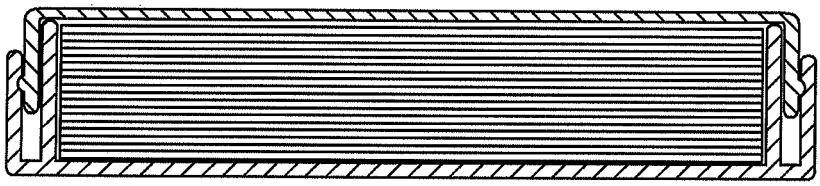
FIG. 6A illustrates a state where a maximum number of normal sheets are accommodated in a feed tray in the related art.
Figure 6B:
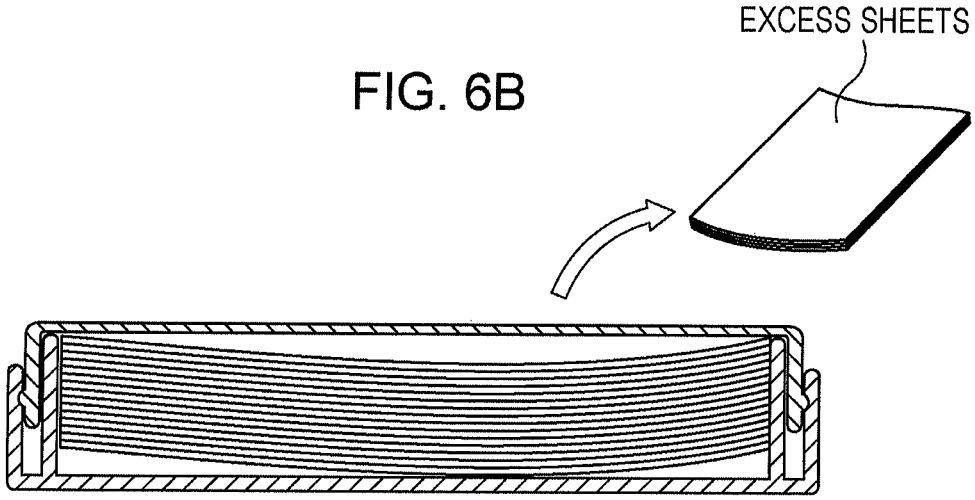
FIG. 6B illustrates a problem occurring when the maximum number of sheets that can be accommodated in the feed tray in the related art are curled.

The downstream edge of the bottom plate 4 is provided with an end plate 12 that extends perpendicularly from the bottom plate 4. Moreover, two cutouts 13 that expose the mounting sections of the bottom plate 4 and the sheet friction section of the tray plate 5 are respectively formed near left and right segments of the end plate 12. A mid-segment of the end plate 12 located between the cutouts 13 is provided with a cutout 15 that extends continuously from a sheet-biasing opening 14 formed in the bottom plate 4. In other words, the opening 14 extending from a substantially mid-area of the bottom plate 4 in the feeding direction to the downstream edge thereof is formed in a mid-section of the bottom plate 4 in the width direction where the tray plate 5 is disposed, so as to connect to the cutout 15 formed in the end plate 12. Referring to FIGS. 5A and 5B, when a feeding process is to be performed, a sheet biasing member 35 provided in the recording apparatus 34 is positioned so as to press the tray plate 5 together with the sheets P stacked in the feed tray 1 toward a feed roller 36 in the recording apparatus 34. Thus, the height of the segment of the end plate 12 where the opening 14 is formed is set such that the sheet biasing member 35 can press the tray plate 5 upward. Each sheet P to be fed is guided toward a recording unit of the recording apparatus 34 along a feed path located above the end plate 12.

The sheet support surface of the bottom plate 4 is provided with a plurality of streak-like projections 16 that are located upstream of the tray plate 5 and that extend in the feeding direction. The top of each projection 16 is substantially aligned with the surface of the tray plate 5. The projections 16 support the trailing side of the sheets P so as to support the sheets P in a parallel fashion together with the upper surface of the tray plate 5.

The feed tray 1 according to the present embodiment has a cover 17 that covers the upstream side of the upper surface of the tray body 2. The cover 17 is constituted by the first cover 17*a* that covers a portion of the upper opening of the tray body 2 when the feed tray 1 is fitted to the recording apparatus 34, and the second cover (not shown) that covers the entire upper opening of the tray body 2 together with the first cover 17*a* when the feed tray 1 is detached from the recording apparatus 34.

In the present embodiment, the first cover 17*a* has a top plate 19 that covers only the upstream side of the upper surface of the tray body 2 so as to ensure a conveying path for the sheets P in the upper surface of the tray body 2. The top plate 19 is a substantially flat plate whose upper surface is provided with a gently-sloped protrusion 20 that is located near the middle thereof in the feeding direction and that is circular-arc shaped in cross section taken in the feeding direction. When the feed tray 1 is fitted to the recording apparatus 34, the top plate 19 extends outward from the recording apparatus 34 so as to cover the entire upstream area of the upper surface of the tray body 2. Moreover, substantially tabular left and right side plates 21 respectively extend perpendicularly from left and right sides, in the width direction, of the lower surface of the top plate 19. Furthermore, an end plate 22 extends perpendicularly from the upstream edge of the lower surface of the top plate 19 and is connected to the two side plates 21.

The pins 11 formed in the cover accommodating sections 10 of the tray body 2 are slidably lockable to locking holes 21*a* formed near the upstream ends of the two side plates 21.

By using the pins 11 as rotation shafts, the first cover 17*a* can be rotated away from the tray body 2.

The top plate 19 has a downstream edge 19*a* that is designed so as to ensure the conveying path for the sheets P in the upper surface of the tray body 2 and that is located so as not to be exposed from the recording apparatus 34 when the feed tray 1 is fitted to the recording apparatus 34. In the present embodiment, the edge 19*a* may extend linearly in a direction perpendicular to the feeding direction. Accordingly, the top plate 19 of the first cover 17*a* may be provided with a substantially linear downstream edge 19*a* extending perpendicularly to the feeding direction, without forming a clearance as in a feed tray in the related art, thereby reliably preventing problems, such as entry of foreign matter into the tray body 2 and discoloration of the sheets P accommodated in the feed tray 1 caused by exposure to sunlight in a state where the feed tray 1 is fitted to the recording apparatus 34.

In the feed tray 1 according to the present embodiment, the first cover 17*a* is attached to the tray body 2 so as to be movable upward away from the tray body 2 from a closed state in which the first cover 17*a* covers the upper surface of the tray body 2.

In detail, as shown in FIGS. 1D, 1E, 2D, and 2E, the first cover 17*a* and the tray body 2 may be provided with pairs of lock portions 31 for locking the first cover 17*a* and the tray body 2 to each other in the state where the first cover 17*a* is rotated to cover the upper surface of the tray body 2 (i.e., closed state). Specifically, the lock portions 31 are capable of adjusting the locked state during the closed state.

More specifically, the first cover 17*a* is provided with engagement protrusions 31*a*, which function as the lock portions 31 and protrude laterally outward, at the downstream ends (non-base ends) of the two side plates 21. Furthermore, cutouts 32 that extend in the height direction of the side plates 21 and that divide the side plates 21 into segments are formed immediately upstream of the engagement protrusions 31*a*.

Figure 2E:
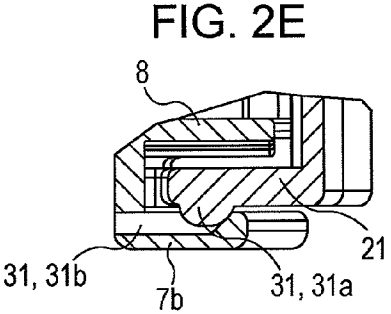

The two second side plates 7*b* of the tray body 2 are provided with engagement recesses 31*b* that engage with the engagement protrusions 31*a* when the first cover 17*a* is fitted into the cover accommodating sections 10. As shown in FIG. 2E, the engagement recesses 31*b* are formed such that the engagement protrusions 31*a* are slidable in the engagement recesses 31*b* with the rotation of the first cover 17*a*. Specifically, in a locked state (i.e., closed state) obtained by rotating the first cover 17*a* to cover the tray body 2 and then engaging the engagement protrusions 31*a* to the engagement recesses 31*b*, the position of the engagement protrusions 31*a* within the engagement recesses 31*b* is changed so as to create looseness due to play, whereby the position of the first cover 17*a* is adjustable relative to the upper surface of the tray body 2.

Locking holes 20*a* are formed near the mid-sections, corresponding to the protrusion 20 of the first cover 17*a*, of the side plates 21 in the longitudinal direction. By locking pins formed in the second cover to these locking holes 20*a*, the second cover can be supported in a rotatable manner about these pins functioning as rotation shafts.

Although the second cover is not shown in the drawings, a simple description of the second cover is as follows. The second cover has a substantially tabular top plate. Left and right side plates substantially having a tabular shape respectively extend perpendicularly from left and right sides of the top plate in the width direction. An edge of the lower surface of the top plate, which is a downstream edge when the second cover is closed, is provided with an end plate that extends perpendicularly from the top plate and that is connected to the two side plates.

The other edge of the top plate, which is an upstream edge when the second cover is closed, is an open edge. The two side plates further extend from this open edge so as to form rotatable leg segments of the second cover. The aforementioned pins that are engageable with the locking holes 20*a* in the first cover 17*a* are formed at the inner sides near the ends of the rotatable leg segments.

Furthermore, the two side plates of the second cover are provided with lock members at the downstream side thereof when the second cover is in the closed state. When the second cover is closed so that the upper opening of the tray body 2 is covered by the first cover 17*a* and the second cover, the lock members are locked to the lock-member engagement sections 25 formed in the first side plates 7*a* of the tray body 2. By locking the lock members to the lock-member engagement sections 25 formed in the first side plates 7*a* of the tray body 2, the second cover (and the cover 17 by extension) can be set in a locked state.

Next, the operation and advantages of the feed tray 1 according to the present embodiment will be described.

First, when stacking and accommodating the sheets P in the feed tray 1 having the above-described configuration, the sheets P are placed on the bottom plate 4 and the tray plate 5 of the tray body 2, the first cover 17*a* is set to cover the upper opening of the tray body 2, and the engagement protrusions 31*a* are brought into engagement with the engagement recesses 31*b*, thereby obtaining a locked state.

When obtaining this locked state, since the engagement protrusions 31*a* formed in the side plates 21 come into abutment with the downstream edges of the second side plates 7*b* of the tray body 2, the engagement protrusions 31*a* are brought into engagement with the engagement recesses 31*b* formed in the tray body 2 while the downstream side of the first cover 17*a* relative to the cutouts 32 formed in the side plates 21 of the first cover 17*a* is bent about an axis defined by a base end 32*a* serving as a section joined to the top plate 19, whereby a locked state (i.e., closed state) is obtained. FIGS. 1A to 1E illustrate a state where the top plate 19 of the first cover 17*a* set in a normal position covers the upper surface of the tray body 2 (the sheets P are not shown in FIGS. 1A to 1E).

Even when the feed tray 1 accommodates a maximum number of sheets P, if the sheets P to be fed for recording are curled in the width direction, it may sometimes be difficult to engage the engagement protrusions 31*a* with the engagement recesses 31*b* in a state where the top plate 19 of the first cover 17*a* is set in the normal position. In that case, the first cover 17*a* is set to cover the upper surface of the tray body 2 while pressing down on the sheets P so that the engagement protrusions 31*a* can be brought into engagement with the engagement recesses 31*b*, thereby obtaining the locked state.

When the sheets P come into abutment with the lower surface of the first cover 17*a*, the engagement protrusions 31*a* slide within the engagement recesses 31*b* while the downstream side of the first cover 17*a* rotates upward away from the tray body 2 about the rotation shafts defined by the pins 11 inserted in the locking holes 21*a* located at the upstream side, so that the locked state is maintained while the first cover 17*a* is pushed upward by the sheets P. FIGS. 2A to 2E illustrate a state where the first cover 17*a* is pushed upward by the sheets P so that the top plate 19 in a rotated position covers the upper surface of the tray body 2 (the sheets P are not shown in FIGS. 2A to 2E).

With the feed tray 1 according to the present embodiment, since the first cover 17*a* is attached to the tray body 2 in a movable manner in the direction away from the tray body 2 while covering the upper surface of the tray body 2, the feed tray 1 according to the present embodiment can reliably accommodate a larger number of sheets P without being increased in thickness, as compared with a feed tray in the related art in which the first cover is fixed to the tray body.

Figure 2B:
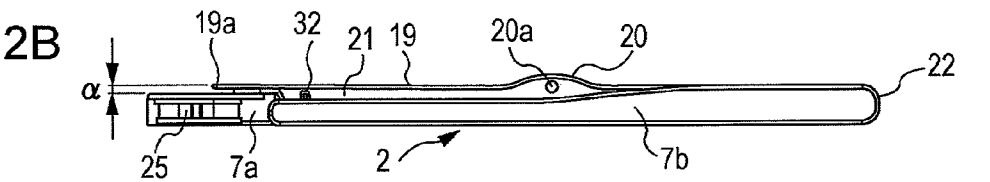
Figure 2C:
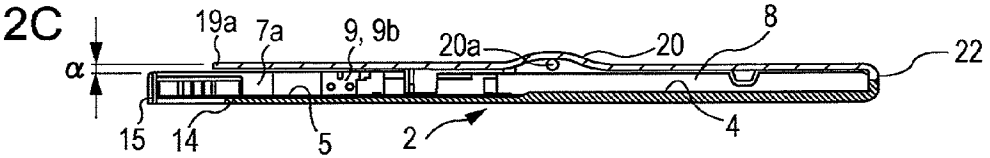

For example, with reference to the description of the above example, even when a set of 18 thick sheets P are curled, the downstream side of the first cover 17*a* rotates upward about the rotation shafts defined by the pins 11 inserted in the locking holes 21*a* located at the upstream side while the engagement protrusions 31*a* slide within the engagement recesses 31*b*, as shown in FIGS. 2B and 2C, whereby the feed tray 1 can accommodate all of the sheets P without being increased in thickness.

In the feed tray 1 according to the present embodiment, even when the first cover 17*a* is pushed upward by the curled sheets P, the second side plates 7*b* located at the sides of the tray body 2 can prevent foreign matter from entering the tray body 2.

Furthermore, when the feed tray 1 is to be fitted to the recording apparatus 34, the second cover is rotated toward the upstream side about rotation shafts defined by the pins formed in the rotatable leg segments of the second cover and locked to the locking holes 20*a* in the side plates 21 of the first cover 17*a*, so that the surface of the top plate of the second cover is positioned facing the surface of the top plate 19 of the first cover 17*a*. Then, the mounting sections exposed through the cutouts 13 in the end plate 12 located at the downstream side of the tray body 2 are mounted to tray mounting sections formed in the recording apparatus 34.

Even when the sheets P are curled in the width direction, the feed tray 1 is still set in the recording apparatus 34. When performing a feeding process, the curled sheets P are uncurled in the following manner. First, the sheet biasing member 35 moves into the opening 14 formed in the bottom plate 4 and the cutout 15 formed in the end plate 12. Then, the tray plate 5 disposed at the bottom of the tray body 2 pivots so that the downstream side of the tray plate 5 brings the sheets P into pressure contact with the feed roller 36 disposed within the recording apparatus 34. At this time, the sheets P not covered by the first cover 17*a* at the downstream side of the upper surface of the tray body 2 are nipped between the feed roller 36 and the tray plate 5, thereby uncurling the sheets P.

Subsequently, the feed roller 36 is rotationally driven so that the sheets P pressed toward the feed roller 36 together with the tray plate 5 are separated and conveyed downstream in the conveying direction in a one-by-one fashion.

In this case, even if the sheet P being conveyed slides into contact with the lower surface of the first cover 17*a* due to a curl in the sheet P, the first cover 17*a* moves away from the tray body 2 while maintaining the locked state so that sliding friction between the sheet P being conveyed and the first cover 17*a* can be reduced to a degree that does not cause trouble in the conveying process of the sheet P. Consequently, the occurrence of errors, such as an inability to convey the sheet P, can be effectively prevented, as compared with the related art in which the first cover 17*a* is fixed to the tray body 2, thereby allowing for a stable conveying process of the sheet P.

With the above configuration in which the first cover 17*a* is movable away from the tray body 2 while maintaining the locked state, the top plate 19 of the first cover 17*a* can be provided with a linear downstream edge extending perpendicularly to the feeding direction, without forming a clearance as in a feed tray in the related art. Even when the sheet P being conveyed slides into contact with this downstream edge (to an extent that this does not cause trouble in the conveying process), since the sheet P would come into contact with the downstream edge substantially uniformly in the width direction of the sheet P, the sheet P can be prevented from being skewed.

The present invention is not to be limited to the above-described embodiment, and permits various modifications where appropriate.

What is claimed is:

1. A feed tray comprising:

a tray body that is fittable to a recording apparatus and that accommodates a stack of multiple sheets;

a tray plate that is disposed at a bottom of the tray body and that is pivotable so as to bring a downstream side of the accommodated sheets in a feeding direction into pressure contact with a feed roller disposed in the recording apparatus; and a cover having a top plate that covers an upstream side, in the feeding direction, of an upper surface of the tray body, wherein the cover is attached to the tray body such that at least the downstream portion of the cover in the feeding direction is movable away from the tray body when the cover is in a closed state for covering the upper surface of the tray body, and wherein the top plate covers an entire upstream area, in the feeding direction, of the upper surface of the tray body extending outward from the recording apparatus when the feed tray is fitted to the recording apparatus , wherein an upstream portion of the cover in the feeding direction is axially supported so that the cover is rotatable relative to the tray body;

wherein the cover has a side plate provided perpendicular to a lower surface of the top plate and extending in the feeding direction of the sheets, and an upstream portion of the side plate in the feeding direction is axially supported so that the cover is rotatable relative to the tray body, and wherein the cover and the tray body are respectively provided with a pair of lock portions for locking the cover and the tray body to each other when the cover is rotated into the closed state for covering the upper surface of the tray body, the lock portions being formed so as to be capable of adjusting the locked state during the closed state.

2. The feed tray according to claim 1, wherein the top plate of the cover has a downstream edge, in the feeding direction, that extends linearly in a direction perpendicular to the feeding direction.

* * * * *